US005158332A

United States Patent [19]

Goulter et al.

[11] Patent Number: 5,158,332

[45] Date of Patent: Oct. 27, 1992

[54] SPRING-LOADED CARRIER FOR SURVEYOR'S LATHS AND OTHER EQUIPMENT

[76] Inventors: Victor H. Goulter, 485 Molimo Dr., San Francisco, Calif. 94127; John C. Lopez, 2469 Shawn Dr., San Pablo, Calif. 94806

[21] Appl. No.: 686,790

[22] Filed: Apr. 17, 1991

[51] Int. Cl.[5] ..... B65D 85/62

[52] U.S. Cl. ..... 294/146; 294/162

[58] Field of Search ..... 294/143, 146, 147, 159, 294/162, 163; 206/305, 443

[56] References Cited

U.S. PATENT DOCUMENTS

| | | | |
|---|---|---|---|
| 1,109,496 | 9/1914 | Woodbury | 294/162 X |
| 3,893,607 | 7/1975 | Jones | 224/45 R |
| 4,269,337 | 5/1981 | Sobotka | 294/163 |
| 4,274,571 | 6/1981 | Lafreniere et al. | 294/147 |
| 4,277,006 | 7/1981 | Pinckard | 294/162 X |
| 4,326,746 | 4/1982 | Grihalva | 294/146 |
| 4,487,443 | 12/1984 | Adamick | 294/151 |

*Primary Examiner*—Margaret A. Focarino

*Assistant Examiner*—Dean J. Kramer

[57] ABSTRACT

A carrier (20) for surveyor's equipment has two spaced-apart walls (23 and 25) providing a passageway (21) above and below spacers (29' and 29) respectively, for stacking laths (27) therethrough. A plunger (31) operates in two vertical slots (47 and 47') in walls (23 and 25) and exerts downward pressure on laths (27) under pressure of springs (49 and 49'), thus preventing the laths (27) from slipping out during use. Springs (49 and 49') are housed in triangular frames and are covered by plates 44. The carrier has a bin formed by curved wall (90) for holding hubs and guinnes (18) and pockets (77) for holding nails, tacks, a hand-held radio, etc. Rubber pads (63) hold the prism rod securely for long distance carrying, and clips 65 for temporary short distance carrying. An easy to grasp handle (72) and shoulder strap (70) provide comfortable means for carrying the device by hand and on one's shoulder. A second embodiment, used by grade setters, has two passageways (92A and 92B) arranged side by side for holding up to 60 laths (27).

16 Claims, 9 Drawing Sheets

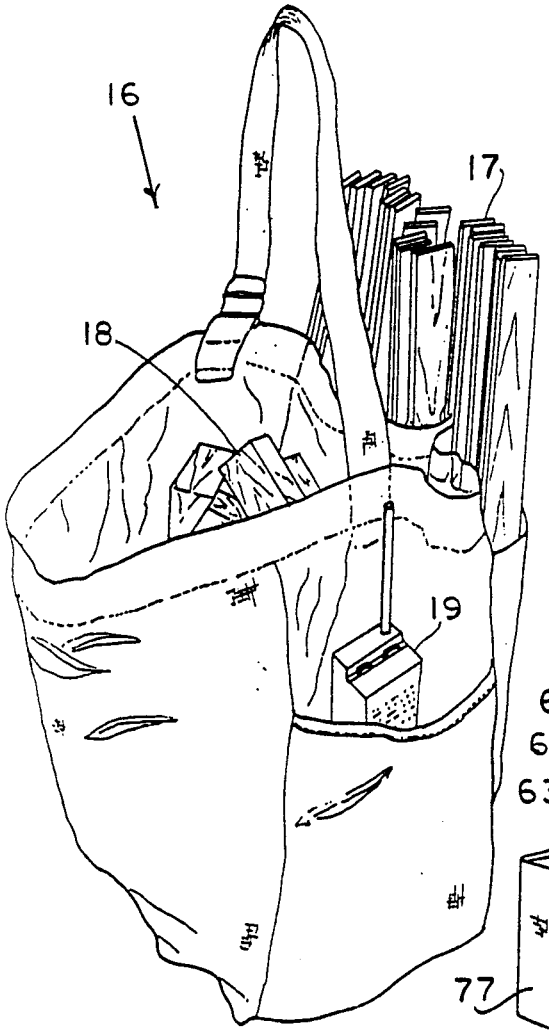
FIG 1 PRIOR-ART
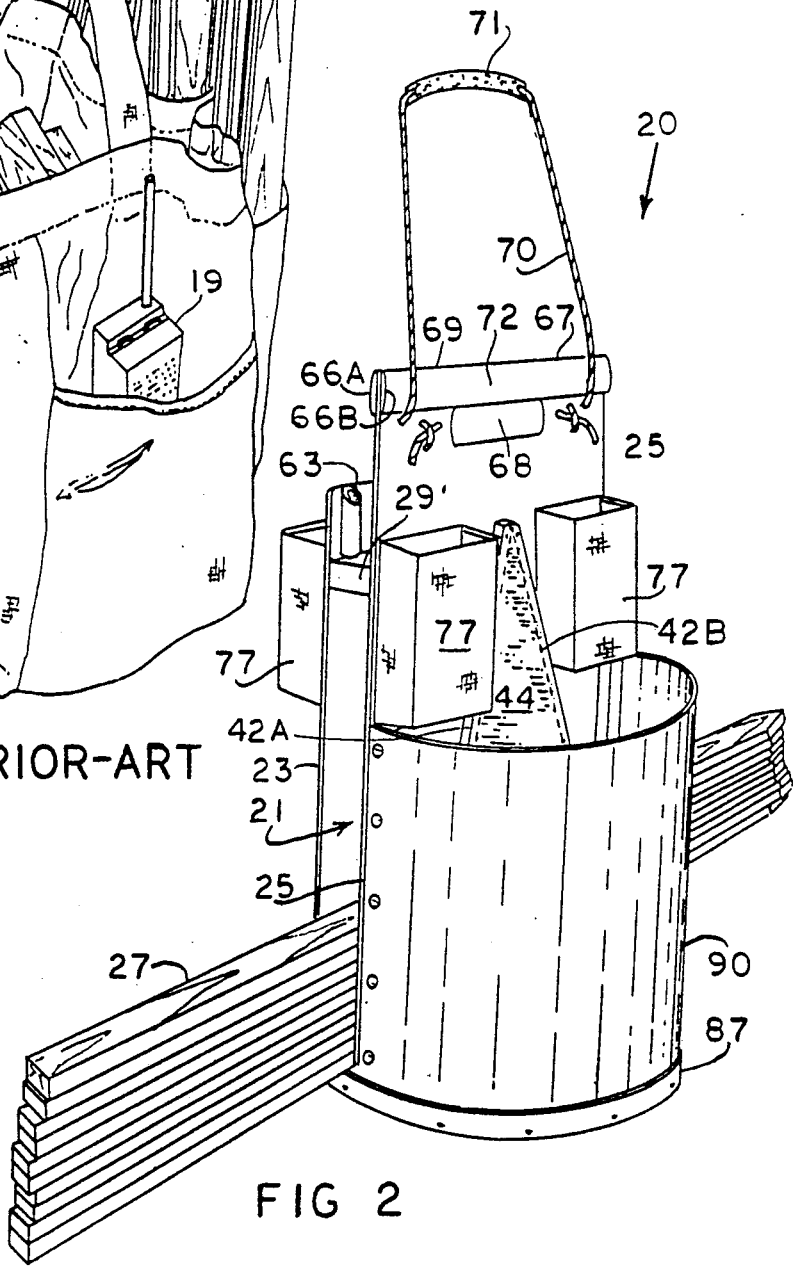
FIG 2

37'
36'
59
33
59
51
37
39
39'
35
36

56
45
7
59
41
43
43'
48A
48B
58
7

21
48B
25
49'
23
49
57
51
58
47'
47
39'
39
37'
37
45
55
59
45
41
51
45
59
37
39'
39
43
43'
52
50
48A

37'
41
58

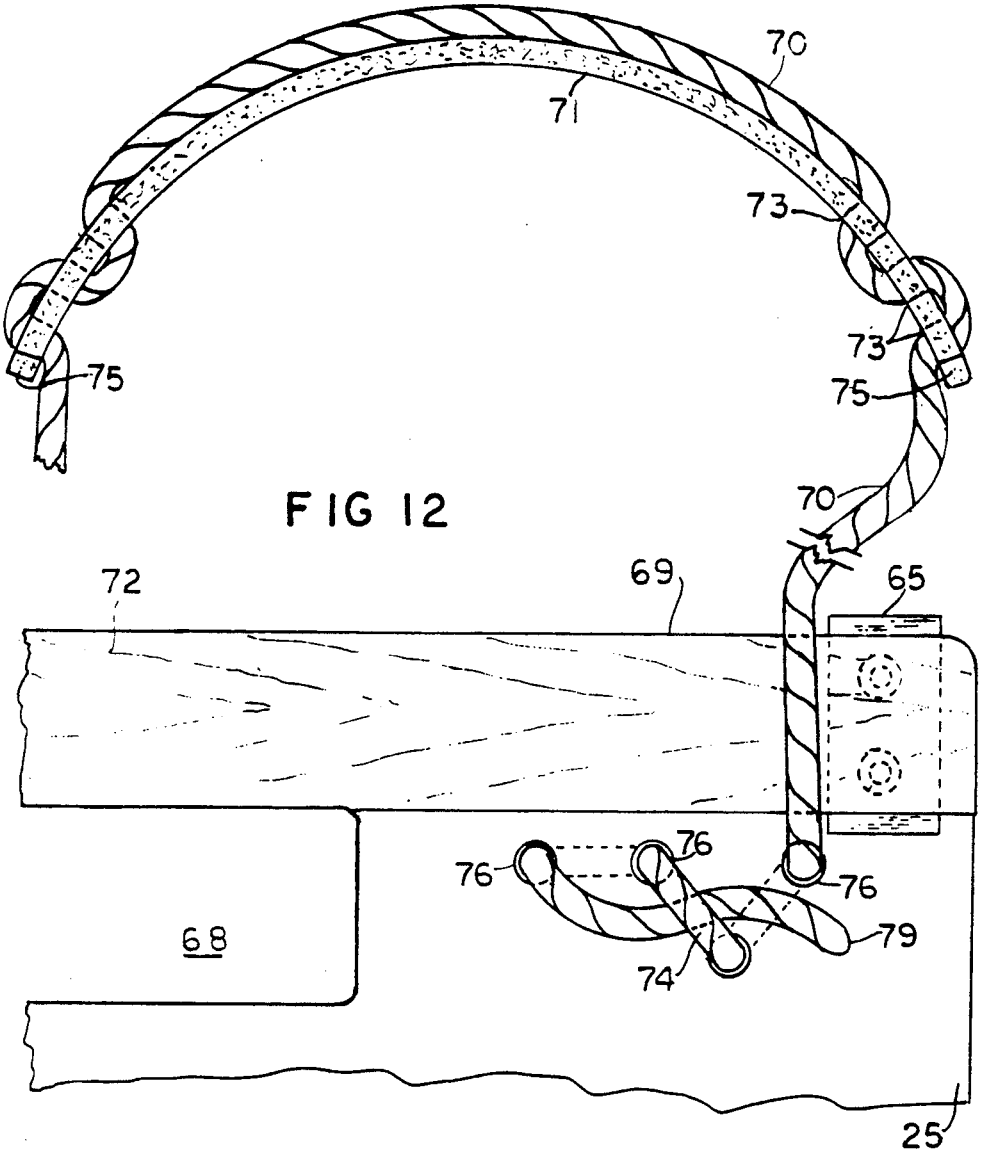
FIG 12
FIG 13
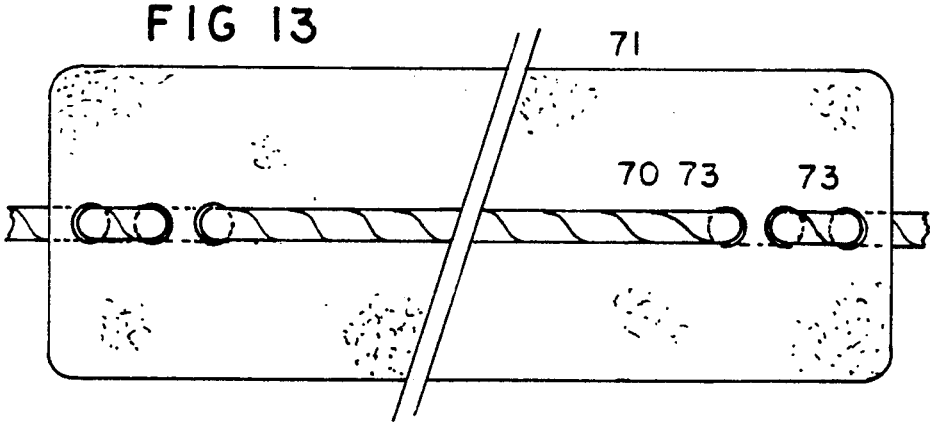

SPRING-LOADED CARRIER FOR SURVEYOR'S LATHS AND OTHER EQUIPMENT

BACKGROUND

1. Field of Invention

The present invention relates to surveying, in particular to a carrier for holding laths, hubs and other equipment used by surveyors in the field.

2. Description of Prior-Art

In surveying, at the beginning of a day's work, after a survey crew arrive on a job site, a foreman or party chief sets up an E.D.M. (electronic distance meter) at a control point.

A rodman, who cooperates with the party chief, loads the equipment required into a canvas bag. The equipment includes: various wooden stakes, a 2–5 Kg. (4–10 lb.) hammer, a hand-held two-way radio, 20 mm tacks, measuring tape, and a prism reflector mounted on a 152 cm (5 ft.) pointed rod.

Up to 30 of the wooden stakes, (known as "hubs" when square in cross section and "guinnes" when round), may be carried in the canvas bag. Also 30 flat wooden stakes 45 cm (18") long (known as short laths) or 122 cm (4 ft.) stakes (known as long laths) are also carried. The laths are flat wooden stakes, 38 mm (1½") wide and 8 mm (⅜") thick and are pointed at one end for easy insertion into the ground. The top portion is spray painted in orange and has specific information, such as station name, distance, depth of cut, etc., written thereon. The short laths are then arranged in order of the surveying program to be followed that day and placed in three pockets (eight to each pocket) on the side of the canvas bag.

The party chief and rodman confer and recheck the laths and the order in which they are placed in the pockets. The party chief then points the rodman in the direction of the first station and tells him or her a specific distance to walk. The rodman then paces (steps) this distance. Then by the use of hand-held radios, the party chief tells the rodman to move to left or right, called putting the rodman "on line". Next, the rodman stands the prism reflector and its rod vertically, while the party chief takes a sample distance reading with the EDM. The party chief may inform the rodman to come closer, or move further away. More distance reading shots are taken until the rod is at the exact distance. The rodman then drives a square peg, (hub) into the ground with the hammer. A final checking shot is made with the EDM, and if the distance is correct, a concave head tack is hammered into the hub.

The position of a station, i.e., where a hub is to be hammered in, is calculated in feet and hundredths of a foot from a starting point, known as 0+00. On curved lanes the stations are closer together than on straight-line work. The rodman moves from one to the next station carrying the canvas bag of laths, the hubs, the prism rod, the hammer, the nails, the radio etc. Frequently the terrain is hilly, and the earth scarred and irregular from clearing and grading activities; this makes it difficult to find a level place to set the bag down.

Each station can take from five to twenty minutes to complete, depending on the accuracy required. I.e., surveying a street requires more accuracy than, say, the positioning of a culvert.

The problem with the canvas bag is that, being made of flexible, non-supportive material, it frequently falls or rolls over when placed on the ground. This is especially so if the location is hilly, or irregular from clearing or grading activities. The instability of the bag is also caused by the 45 cm laths being placed vertically in the pockets. Being top-heavy, they are inclined to lay down or roll over. The result is that some of the laths and other equipment often spill out onto the ground. The laths become mixed from their original specific order and before they can be replaced in the pockets, the rodman and the party chief have to confer by radio to rearrange the laths into their proper order.

Long laths, 122 cm (4 ft.) long, are too long to be placed in pockets. Sometimes these are tied together and laid along the top of the bag and tied to it by whatever method the individual can improvise. Other times a surveyor will carry a bundle of long laths under an arm. The problem here is that the bundle has to be untied to remove the needed one, then retied again in order to move along to the next station, which may be only 6 meters (20 feet) away. This is a waste of time.

It should be realized that a bundle of 4 ft. laths, a 5 ft. rod with prism reflector attached, a 10 lb. hammer, a floppy canvas bag with hubs or guinnes, and a radio constitute a very awkward load for one person to carry. It becomes even more awkward as the rodman attempts to place the canvas bag so that it will not roll or tip over.

Another problem with the canvas bag is that when four or five short laths have been taken from one pocket, there is sufficient room for the remaining three or four laths to become mixed. This can happen during carrying and without the rodman being aware of it.

The wooden hubs are 50 mm×50 mm×130 mm or 200 mm long (otherwise known as 2"×2"×5" or 8" hubs) and are pointed at one end. The round guinnes are 25 mm (1") in diameter and 130 mm or 200 mm (5" or 8") long, and are also pointed at one end. The sharpened points constantly wear the canvas bag during carrying, or during putting down and picking up. Thus the bag has to be frequently replaced.

In addition, 20 mm (0.75") long concave-head tacks, 15 cm (6") nails, a radio, a reflector prism and rod, a hammer, a measuring tape, and a can of spray paint are carried. Usually a 2–5 Kg (4–10 lb.) hammer is carried in the other hand.

All of the above are usually not carried at any one time. A full load may weigh up to 10 to 15 Kg. (20 to 30 lbs.)

At each location, known as a station, the rodman uses the prism rod by standing it vertically and facing it toward the party chief who is "shooting" a distance reading. There is no place on or in the canvas bag to hold the prism rod after the reading has been taken and while the hub is being hammered in.

When the hub has been driven into the ground, the prism rod point is positioned on top of the hub. The position is checked again and moved slightly, if necessary, until the exact spot is determined. Then a concave-head tack is hammered into the top of the hub in the exact spot. A 45 cm or a 122 cm lath (18" or 4') is marked with identification numbers according to the position of the adjacent hub.

The problem with the pockets being on the side of the canvas bag is that when 45 cm laths are placed vertically in them, they "take control" of the remainder of the floppy bag by pulling the bag in whatever direction the laths tend to fall due to their weight. This causes the bag seemingly to never to be sitting in the most convenient way to either remove a lath or any other object from the bag.

Surveyors also wear a belt on which some equipment is carried, such as a tape measure. Sometimes the radio is also carried on a belt since it can be damaged in the canvas bag. The problem with a belt is that the extra weight has to be carried by the person at all times, even when all the equipment carried is not needed at each station. The inconvenience of the bulk of these tools attached to the person's waist is not appreciated. Some surveyors prefer to be free of this burden by carrying all equipment in the canvas bag.

A further problem is that a handle is attached to the middle of the bag, whereas the lath pockets are along one side, such that when the bag is loaded with an equal number of hubs in the bag, and laths in the pockets, the bag is already grossly unbalanced. Also, as one hub is used, along with one lath at each station, the bag will of course remain unbalanced. To say the least, it is extremely uncomfortable and dangerous to carry, especially along uneven or hilly terrain.

If the bag were loaded only with hubs, it would be balanced. Since hubs are used one by one, the bag will remain balanced. But since common practice is to identify the inserted hub with a 45 cm lath positioned alongside, an equal number of laths must be carried. The only way to carry the laths is to stack them vertically in the three pockets provided. The tendency to imbalance is therefore great at all times.

Another problem with the canvas bag is that it lacks rigidity. Thus each time it is put down, the rodman has to make an effort to prevent it from rolling over and spilling its contents. This effort sometimes requires a number of attempts. This is frustrating and time consuming.

As said before, the bag of equipment can weigh 10 to 15 Kg. This weight must be lifted from near ground level due to the floppy nature of the bag. This creates a heavy back strain on the user.

Insofar as we are aware, no other holder for surveyor's equipment is available or known to the trade.

OBJECTS AND ADVANTAGES

Accordingly several objects and advantages of the present invention are to provide a surveyor's holder or carrier which is balanced, comfortable and safe to carry, does not allow carried laths to spill or slide out, which keeps all the laths in their numerical order, and which never produces a situation in which the rodman and party chief need to confer by radio to reorganize the numerical order of the laths. Further objects and advantages are to provide a holder in which the laths are not placed vertically, are easily accessable, can be loaded or removed one at a time, or many at a time, without disturbing the remaining laths, or without having to tie or untie, also which is supportive and stable and does not roll or tip over.

Other objects and advantages are to provide a holder or carrier having means to hold a prism and its 5 ft. rod, has adequate "easy-to-see" and use pockets for all small equipment, has an easy-to-grasp handle, and shoulder strap for more comfortable long-distance carrying, is balanced, sturdy, is easy to put down or pick up on level or hilly ground and is wear-resistant. Also it can carry the recommended number of pieces of all equipment. Still further objects and advantages will become apparent from a consideration of the ensuring description and accompanying drawings.

REFERENCE NUMERALS

16 canvas bag
17 laths
18 hubs
19 radio
20 carrier
21 passageway
23 first wall
25 second wall
25A–B short and higher wall.
27 lath
29 lower and upper spacer
31 plunger
33 wooden insert
35 body portion
36 ends
37 end projection
39 and 39' holes
41 casing
42A–C strips
43 bottom and top
44 cover plate
45 bolts
46A spring relaxed
46B projected line
46C stretched spring
47 slots
48 sloping end portion
49 tension spring
50 screws
51 hole
52 spring ends
53 bottom edge
54 hole in upper spacer
55 knot
56 large knot
57 control cord
58 enlarged hole
59 slide plates
60 cord lock
61 top edge
62 "V" slot
63 rubber tube or hose
63' bolts
64 prism pole
65 metal clips
66A–C wooden strips
67 handle bar
68 slot
69 top edge
70 carrying cord
71 shoulder strap
72 handle
73 holes in strap
74 loop
75 strap end
76 holes in wall
77 pockets
79 free ends
80 plywood back
80' base
81 canvas
82 screw holes
83 screws
84 bottom 84' staples or tacks
85 base plate
86 curved edge
87 metal band
88 wooden strips
89 rubber feet
90 curved wall
90' edges
91 screws
92 broken line
93A-B passageways
94A.B walls
95 metal strip
96 wooden insert
97 wooden strips
98 baseplate
99 rubber feet

BRIEF DESCRIPTION OF DRAWINGS

FIG. 1 is a perspective view of a prior-art surveyor's carrying bag.

FIG. 2 is a perspective frontal view of a carrier in accordance with the invention.

FIG. 12 is fragmented side view of a carrying rope and shoulder strap, and method of attaching it to the carrier.

FIG. 13 is a top view of a portion of the shoulder strap.

DESCRIPTION OF PRIOR-ART CARRIER—FIG. 1

Figure 3A:
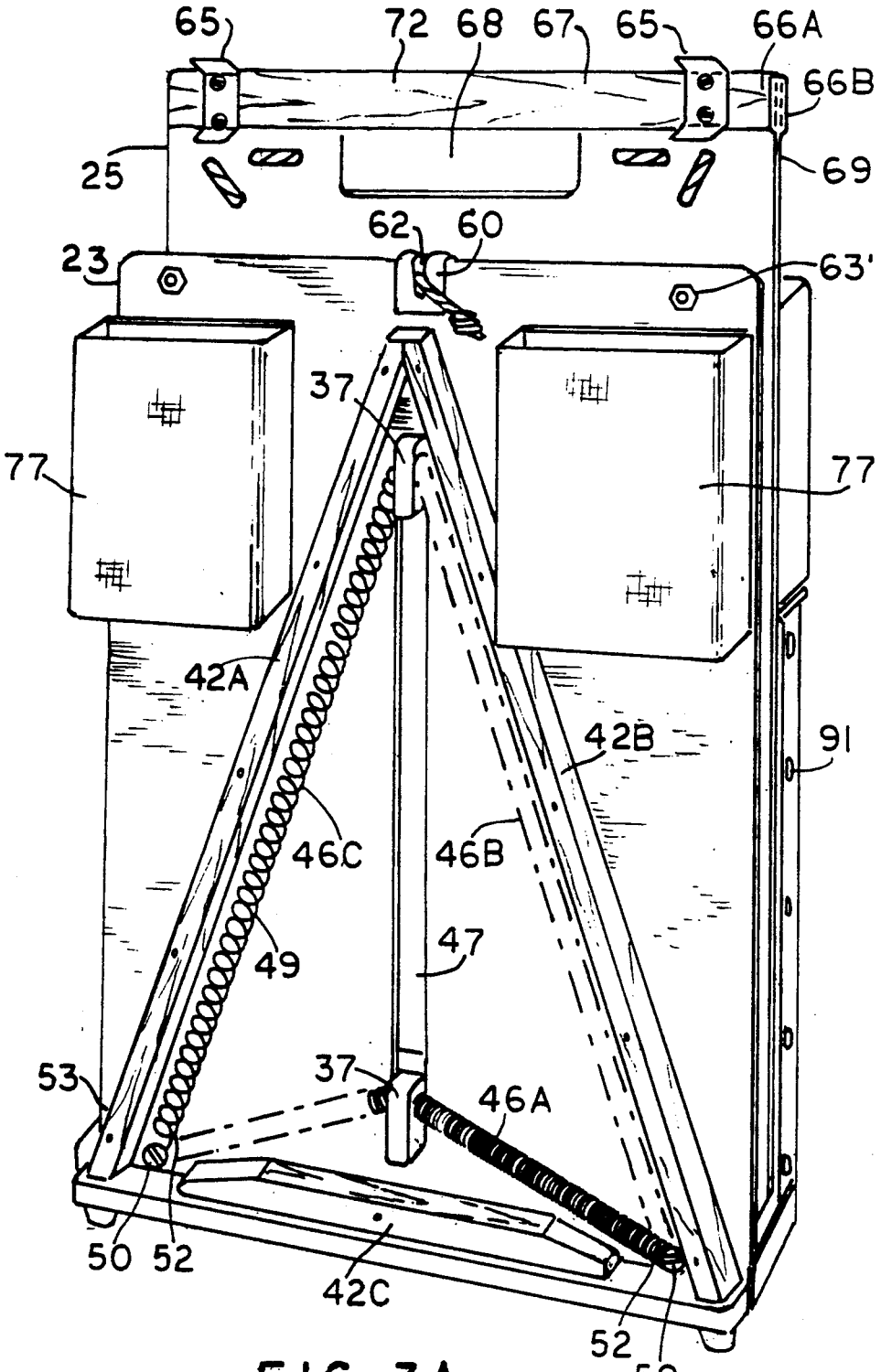
FIG. 3A is a perspective rear view of a carrier with a cover plate removed to show a tension spring and a plunger used in the carrier.

As stated above, surveyors have a variety of equipment to carry with them out in the field. A full load can weight 10 Kg. (20 lb.) or more. In addition a 5 Kg. (10 lb.) hammer is carried in the other hand. This load is carried from station to station, then set down. The prism and two-way radio are used while a position is determined for a hub, or guinnes, to be driven into the ground. Then a painted and numbered lath marker is inserted in the ground nearby.

FIG. 1 shows a prior-art canvas bag 16, loaded with short laths 17, some hubs 18, and a handheld radio 19. As seen, laths 17 are vertically stacked in pockets, and provide a top-heavy weight sufficient to pull flimsy bag 16 to the ground, especially if the terrain is sloping or irregular from clearing or grading. When the bag tips over, some of the laths slip out and lose the precise order in which they were when first packed in the pockets. When the user picks the bag up by its carrying strap weight of the laths pull downward on one side, making the bag of equipment most uncomfortable to carry. This is especially so since the user is also carrying a reflector prism attached to a 5 ft. pointed rod, and a 4 or 10 lb hammer, and a handheld radio. Bag 16 becomes less supportive with age due to wear and tear, and has to be replaced.

DESCRIPTION OF INVENTIVE CARRIER/HOLDER—FIGS. 2-12

FIG. 2 shows a carrier 20 according to the invention. It comprises a passageway 21, formed by a first wall 23 and a second wall 25. Walls 23 and 25 are spaced apart by lower and upper spacers 29 and 29' respectively, best seen in FIG. 3B. Spacers 29 and 29' are about 4 mm to 5 mm (0.187 to 0.25") wider than the width of lath 27. Walls 23 and 25 are about 33 cm. (13") wide. The distance between the upper and lower spacers is about 34.5 cm (13 .5").

Therefore, passageway 21 has sufficient width for the easy insertion of laths and a height sufficient for 30 laths when stacked one above another. Since laths are 38 mm (1.5") wide and about 9 mm (.375") thick, they can be pulled from, or pushed into passageway 21 by hand. Laths 27 are used in two lengths, 122 cm (4 ft.) as shown at 27 in FIG. 2 and 46 cm (18") (not shown).

Irrespective as to the number of laths placed loosely in passageway 21, they are prevented from slipping endwise by a spring-loaded plunger 31 (FIG. 3B) which exerts sufficient downward force on the laths to hold them by friction.

Plunger 31 comprises a wooden insert 33, having a body portion 35 (FIG. 4) and two end projections 37 and 37'. The projections have respective holes 39 and 39' drilled therethrough. Holes 39 and 39' are countersunk on each side. A stainless steel casing 41 is attached to the top 43 and bottom 43' of body portion 35, and secured by vertical bolts 45 (FIGS. 5 and 7). Casing 41 has two diagonally sloping end portions 48A and 48B (FIGS. 3B, 5, and 6), which slope upward at an angle of about 25 degrees from the center point.

Plunger 31 is disposed centrally between walls 23 and 25 (FIGS. 3B, 6, and 8), such that projections 37 and 37' protrude through slots 47 and 47' which are cut vertically in walls 23 and 25 (FIGS. 3A, 3B and 6) and between upper and lower spacers 29 and 29'. Long tension springs 49 and 49' are threaded through holes 39 and 39', respectively, and their ends 52 are anchored by screws 50 to the bottom edges 53 of walls 23 and 25, respectively. Springs 49 and 49' are "close" wound from 0.058 cm (0.023") spring steel and are about 18 cm (7") long and have an outside diameter of 8 mm (0.312"). The ends of each spring can have a normal anchoring hook, or alternatively two or three coils at ends 52 can be bent outward and placed over the heads of anchor screws 50 (FIGS. 2 and 6).

Spring 49, which passes through hole 39 in projection 37 and which is attached to the base of wall 23 (FIG. 3A) is housed and protected within a triangular frame formed by two diagonal wooden strips 42A and 42B and one horizontal base strip 42C. This triangular frame is protected by a flat metal vertical cover plate (not shown).

Figure 3B:
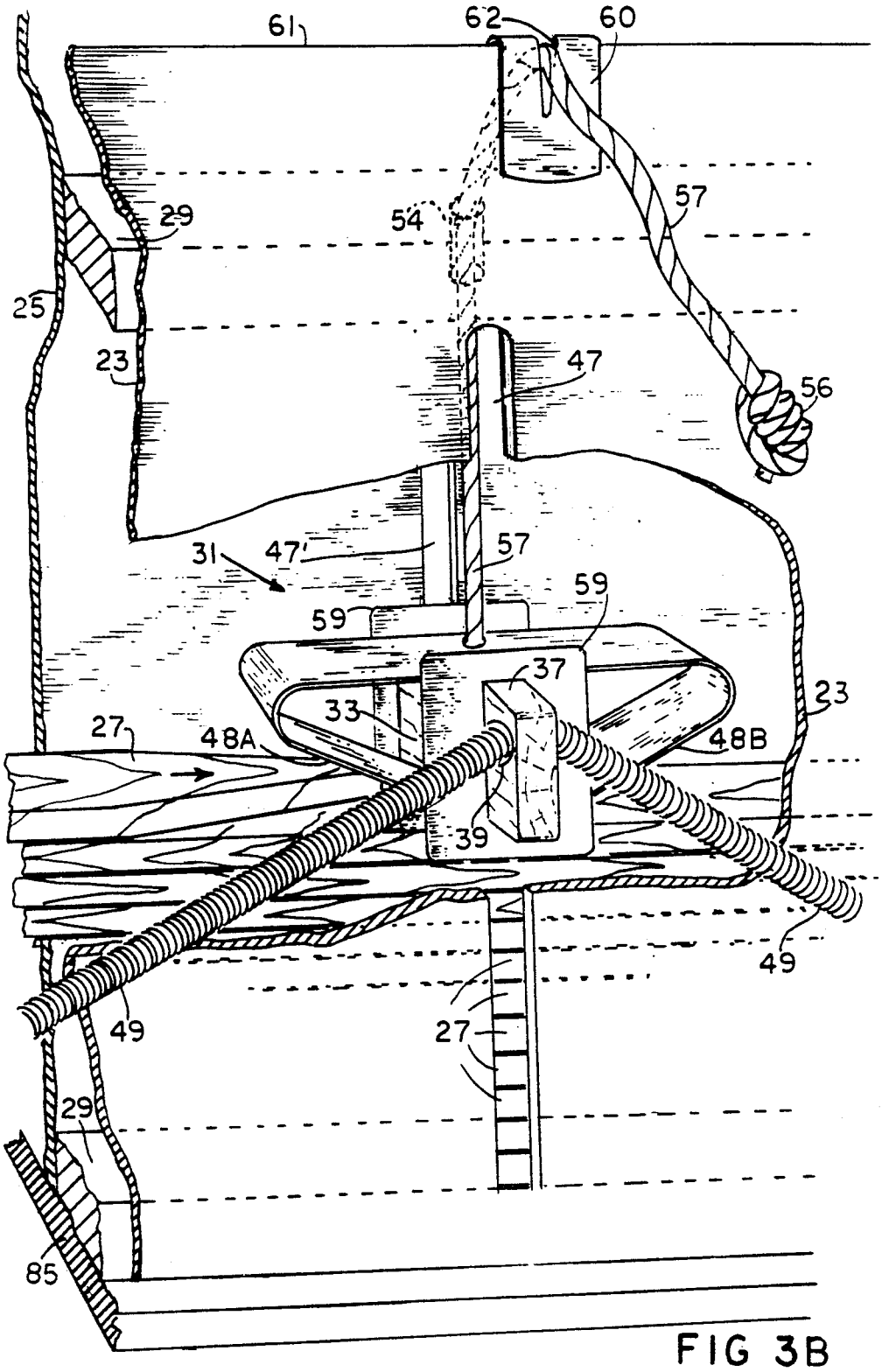
FIG. 3B is a part sectioned rear view showing a spring-loaded plunger mechanism used in the carrier.
Figures 4, 5, 6, 7:
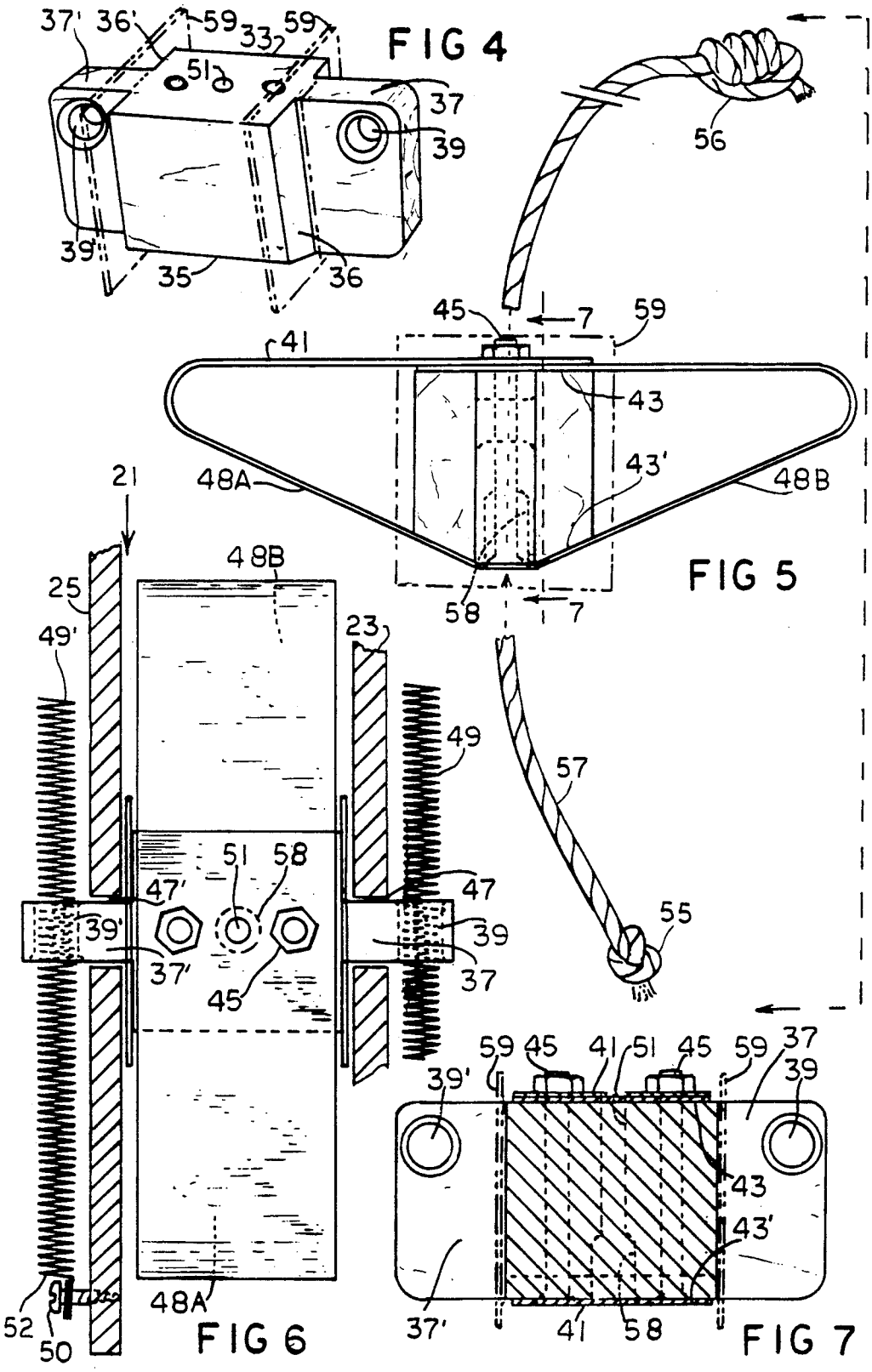
FIG. 4 is a perspective view of a wooden plunger insert used in the carrier.
FIG. 5 is a side view of a plunger casing attached to the insert of FIG. 4.
FIG. 6 is a top view of the plunger of FIG. 5 showing its side walls and tension springs.
FIG. 7 is a sectional view taken along the line 7—7 of FIG. 5.

On the opposite side of passageway 21 (FIGS. 3B and 6), spring 49' passes through hole 39' in projection 37', which protrudes through slot 47' (FIG. 3B). Spring 49' is housed and protected within a similar triangle formed by two diagonal wooden strips 42A and 42B (FIG. 2) and a base strip 42C, (not shown) A triangular metal cover plate 44 is attached by screws (not shown) (FIG. 2).

A centrally drilled hole 51 (FIGS. 4–7) is enlarged at its bottom end 58 so as to permit knot 55 (FIG. 5) at the lower end of control cord 57 to be pulled part way into insert body 33 when cord 57 is pulled through hole 51. Cord 57 then passes upward through hole 54 (FIG. 3B) in upper spacer 29'. The other end of cord 51 has a large knot 56 tied to form a hand grip for raising or lowering plunger 31 (FIGS. 3B and 5).

A cord lock 60 (FIGS. 3A and 3B) comprises a sheet metal inverted "U" bracket fitted in a central position over the top edge 61 of wall 23. It has a narrow "V" groove 62 cut downward from its bent portion which enables it to grab cord 57 when it is loosely placed in the "V" slot.

When plunger 31 is at the bottom of slot 47, spring 49 is almost completely relaxed as shown at 48A (FIG. 3A). However, sufficient pressure is exerted by springs 49 and 49' on plunger 31 in this position to hold one lath (not shown) in passageway 21.

When plunger 31 is pulled to the top of slot 47, by cord 57, spring 49 is stretched from its semi-relaxed position at 46A to projected line 46B position. Spring 49 is shown in the stretched position at 46C (FIG. 3A). In this position, passageway 21 can hold 30 laths. The extra pressure exerted by the stretched spring will prevent thirty laths from slipping out from passageway 21 under working conditions.

A slide plate 59 (FIGS. 3B–7), best seen in FIG. 3B, is positioned over projections 37 and 37' and between body portion end 36 and wall 23, and between body portion end 36' and wall 25, respectively.

PRISM ROD HOLDER—FIGS. 2, 3A, 8 AND 10.

Figure 10A:
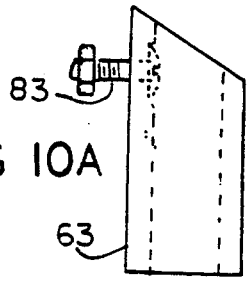
FIG. 10A is a perspective view of a rubber pressure pad.
Figure 10:
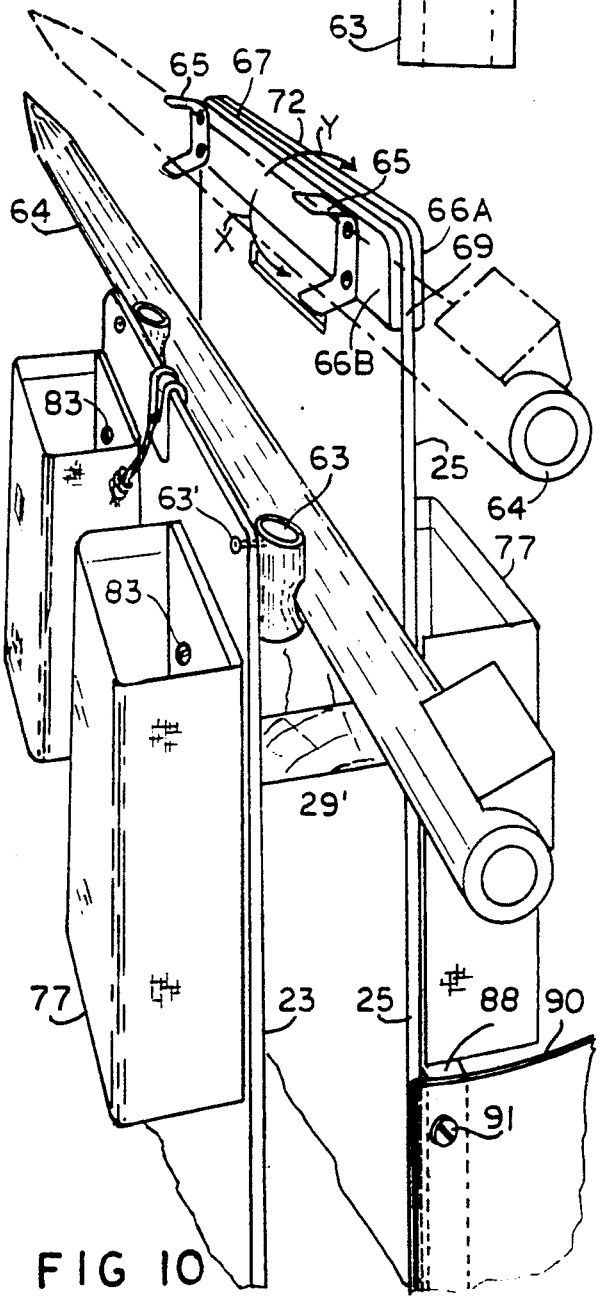
FIG. 10 is a perspective view of the upper portion of the carrier showing a prism rod and its rubber clamps, and alternative metal clip holders for the prism rod.

Two rubber hose pads 63 are attached by bolts 63' (FIGS. 3A, 8 and 10) to top edge 61 of wall 23, for frictionally securing prism pole 64 (FIG. 10). These comprise two short lengths of canvas reinforced rubber hose 63 (FIG. 10A) with their top ends cut at an angle of about 60 degrees.

CARRYING HANDLE—FIGS. 2, 3A AND 10

Reinforcing wooden strips 66A and 66B (FIGS. 2, 3A, and 10), each about 33 cm (13") long, 3 cm (1.25") wide, and 7 mm (0.25") thick, are glued horizontally along each face of wall 25 at top edge 69 to form a handlebar 67. A rectangular slot 68, 12 cm (4.75") long and 3 cm (1.25") wide is removed from wall 25 to provide an easy-to-grasp handle 72 (FIGS. 2 and 10). Handle 72 is at a convenient height of 53 cm (21") from ground level for grasping by hand and is located in a balanced positioned, above and between the array of laths on one side, and the pocket of hubs on the other.

ALTERNATIVE PRISM ROD HOLDER—FIGS. 3A, 8, AND 10

Two metal clips 65 (FIGS. 3A, 8, and 10) are fitted by screws to handlebar 67 at top portion 69 of wall 25 to provide an alternative but temporary carrying position for prism pole 64. Prism pole 64 and handle 72 can be grasped together for carrying short distances by hand.

CARRYING CORD AND SHOULDER STRAP—FIGS. 2, 12, AND 13

A flexible carrying cord 70, fitted with a shoulder strap, 71 (FIGS. 12 and 13), is perforated with three holes 73 at each end 75 of strap 71. Cord 70 is threaded back and forth through holes 73, which secure it in a central position.

Free ends 79 of cord 70 are attached to top 69 of side 25 by threading ends 79 back and forth through two sets of four holes 76 in spaced apart relationship, as shown in FIGS. 2 and 12. The free ends of cord 70 are spliced under loop 74 (FIG. 12) which locks it from slipping when weight is placed on cord 70 and the unit is carried by shoulder strap 71. This provides a quick and easy means of attaching as well as a means for adjusting the length of cord 70 for individual users.

POCKETS—FIGS. 2, 3A, 8, 10, AND 11A–11C

Figure 11A:
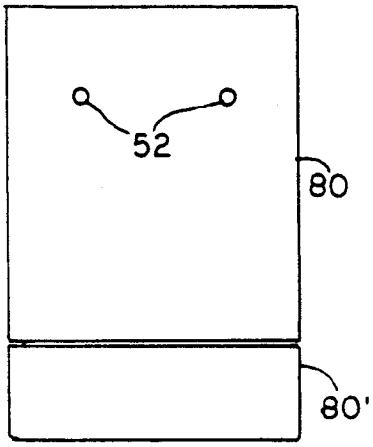
FIG. 11A, 11B, and 11C are perspective views showing construction process used in the making of a canvas pocket used in the invention.
Figure 11B:
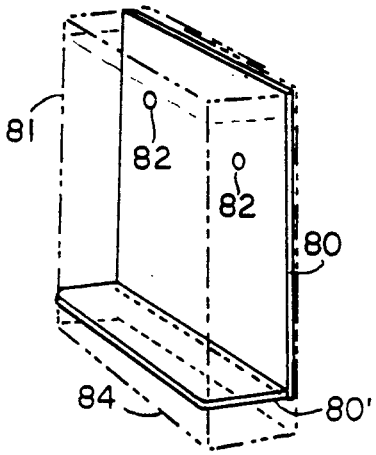
Figure 11C:
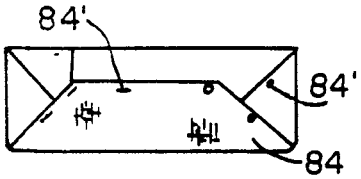

Four rectangular canvas pockets 77 are fitted to the upper portion of walls, 23 and 25. The pockets comprise a strip of canvas 81, 180 mm wide ×340 mm (7"×13.5") long (FIG. 11B). They have a 12 mm (0.5") hem glued or sewn along the top edge. The canvas is then folded and glued around the back of plywood rectangle 80 and a stiff pocket bottom piece 80', e.g., of wood. These measure 13 cm ×10 cm (5"×4") and 100 mm ×37 mm (4"×1.5") respectively. Screw holes 82 are drilled 25 mm (1") from the sides and 28 mm (1.125") from the top edge. Bottom 84 of canvas strip 81 is folded and glued to bottom plate 80' (FIG. 11C) Canvas 81 can be further secured by staples or tacks 84'. Pockets 77 are attached to walls 23 and 25 by screws 83 (FIG. 10).

BASE PLATE AND CURVED WALL—FIGS. 2 AND 9

Figure 9:
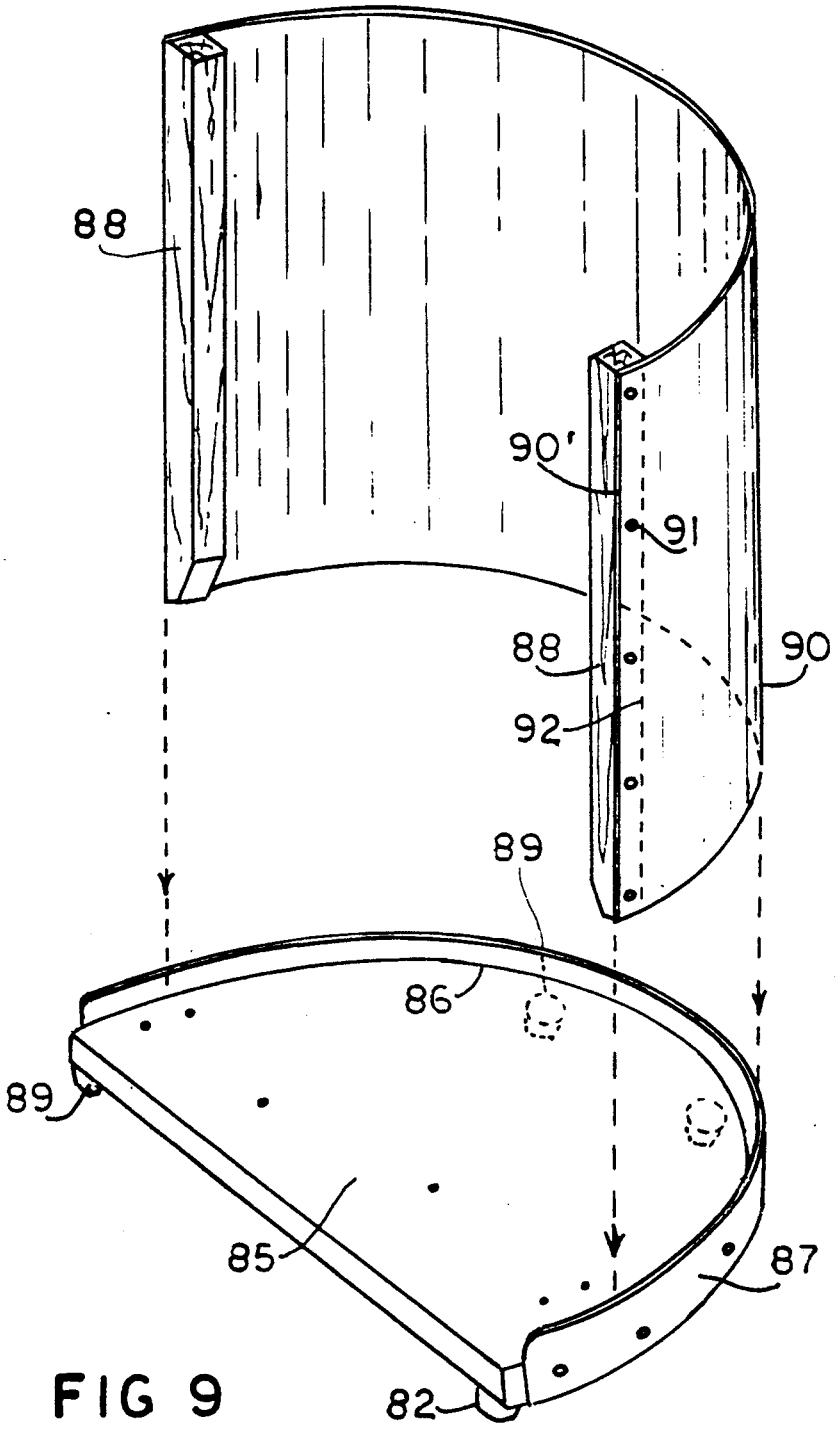
FIG. 9 is a top view of a base plate, and retaining strip, and a curved plastic wall used in the carrier.

A 13 mm (0.5") thick plywood baseplate 85 (FIG. 9) is fitted with a 25 mm (1") wide metal band 87 around its curved edge 86 (FIGS. 2 and 9). Metal band 87 can be made of aluminium, steel, or plastic, or any other suitable material and is screwed or nailed or otherwise attached to the baseplate. Baseplate 85 is about 330 mm wide and 257 mm across (13"×10.125").

Metal band 87 projects upwards 13 mm (0.5") above the surface of baseplate 85, thus providing a supporting rim around curved wall 90 (FIGS. 2, 8, and 9) at its base.

Wooden strips 88 are glued to the edge of wall 25, shown by broken line 92, (FIG. 8) and edges 90' are screwed to strips 93 on both sides of the unit by screws 91.

Figure 8:
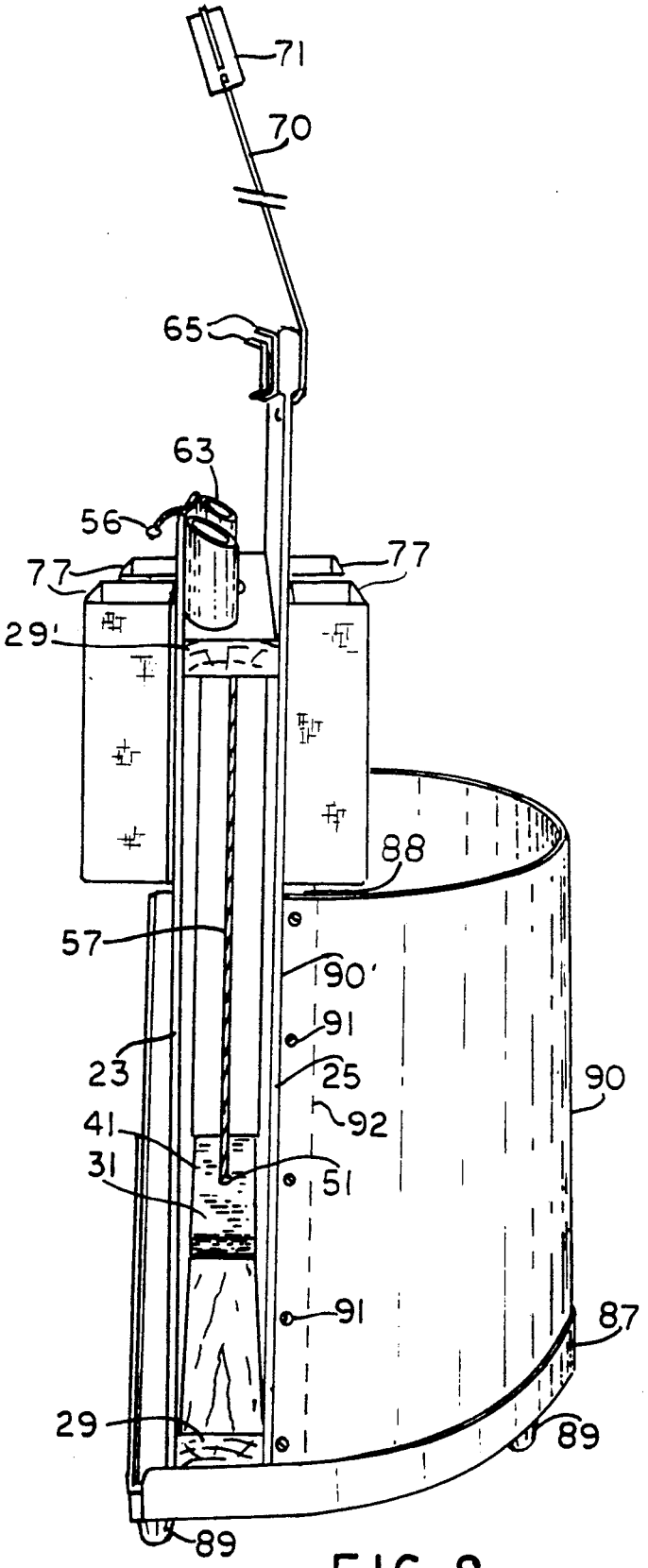
FIG. 8 is a perspective side view of the carrier showing a passageway, a plunger, and a curved retaining wall used for holding equipment.

Four rubber feet 89 are screwed to the bottom of baseplate 85, as shown in FIGS. 8, and 9.

ALTERNATIVE EMBODIMENT FOR GRADE SETTER'S CARRIER—FIG. 14.

Grade setters work with construction workers and erect 122 cm (4ft. ) laths near hubs and short laths placed by surveyors. They read the information written on short laths and direct construction workers as to the depth of cut or build-up of earth at each station. They carry up to 60 laths in a bundle and drop one at each station, then return with a hammer and drive the laths into the ground near the hubs. They return a second time to spray paint the upper portion a bright orange color for clear visibility.

Figures 14, 15:
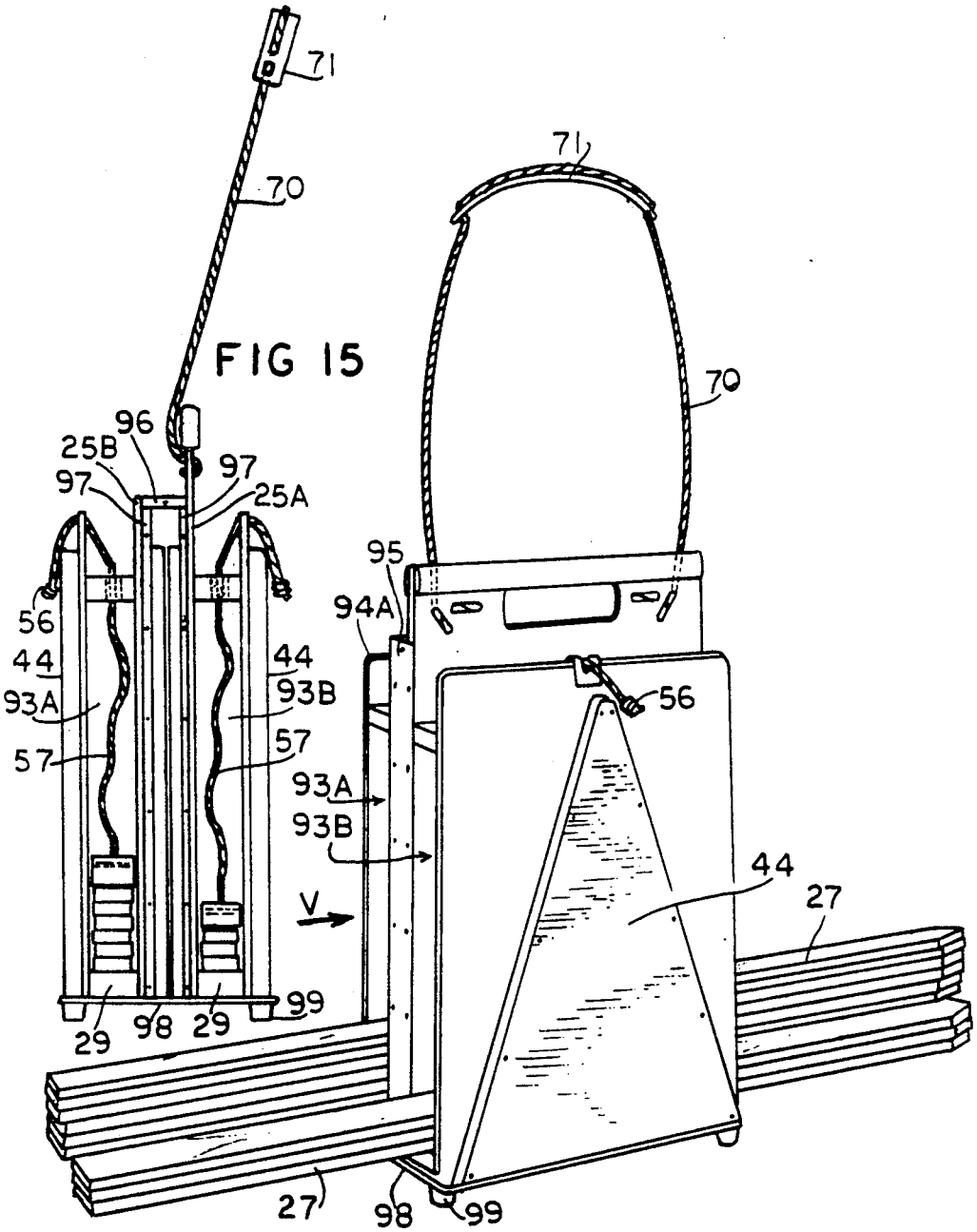
FIG. 14 is a perspective view of second embodiment of a carrier used by grade setters for carrying laths.
FIG. 15 is a side view of the embodiment of FIG. 14 with its metal cover strips removed.

FIG. 14 shows a grade setter's carrier comprising two passageways 93A and 93B which are identical to those used in a surveyor's carrier, except that the top portion of wall 94A is shortened as shown in FIG. 14. The two units are joined together by a metal strip 95 on each side, and a wooden insert 96 (FIG. 15) along the top. Metal strips 95 are screwed to wooden strips 97 which in turn are glued to walls 25A and 25B. In addition, a metal or wooden baseplate 98 is attached to the lower spacer 29 of each unit. Rubber feet 99 are attached to each corner of baseplate 98.

OPERATION, LOADING, AND REMOVING LATHS—FIGS. 2-5

Before loading laths into the carrier, the laths are spray painted and each is marked with the required information needed by the grade setters to work with the constructors.

The laths can be slipped, point first, into passageway 21, either one or two at a time without the need to manually raise the plunger. The point of the lath will engage sloping end portion 48 of plunger 31 (FIG. 3B) and will automatically lift plunger 31 against the downward tension of springs 49 and 49' (FIG. 2 and 3B). Alternatively, plunger 31 can be manually raised as far as is required to provide space for up to 30 laths. This is done by pulling cord knot 56 upward and locking cord 57 in slot 62 (FIG. 3A and 3B). After loading is completed, cord 57 is released, allowing the plunger to apply downward pressure on the laths, thus preventing them from slipping out of passageway 21. When the first lath is required, the user simply pulls the lath out, whereupon plunger 31 will automatically be pulled down against the next lath by the springs. Alternatively, the user can raise plunger 31 by pulling on cord 57, and remove the lath. Plunger 31 will hold either short or long laths against slipping out, even if the carrier is on a steep incline or hill.

LOADING HUBS AND GUINNES—FIGS. 2 AND 8

Hubs and/or gunnies can simply be dropped into the cavity or bin provided by curved wall 90, or they can be stacked neatly therein for maximum holding quantity. The bin will hold (about 30, 20 cm (8") hubs, 40, 13 cm (5") hubs, (40, 20 cm (8") guinnes, or 50, 13 cm (5") guinnes).

LOADING THE PRISM AND ROD—FIGS. 10

Prism rod 64 is about 32 mm (1.25") thick and is fitted between wall 25 and rubber tube pads 63. This space is 20 mm (0.75") wide. Therefore rubber pads 63 have to be deformed or compressed 12 mm (0.5") by the insertion of rod 64. This pressure is sufficient to hold the prism rod securely during carrying over long distances. However, when carrying short distances, such security is not necessary. Prism rod 64 can be held in position in brackets 65 (FIG. 10) by hand against handle 72 when carrying the holder, shown by arrows X and Y, (FIG. 10). When holder is placed on the ground, the prism rod is easily removed and ready for immediate use.

LOADING THE CANVAS POCKETS—FIGS. 2 AND 8

Each user can carry a radio, or tacks, 15 cm (6") nails or tape, or spray paint, in any of pockets 77. A pocket can hold 50 150 mm (6") nails. The pockets are at a convenient height for easy visibility or removing or replacing of the contents. Also, since the pockets have a hard bottom, they are kept in an open shape which facilitates easy insertion and removal of the equipment carried therein.

USING THE CARRYING STRAP—FIGS. 12 AND 13

Since the carrying strap is very flexible, it can be placed out of the way when not in use and also be easily adjusted for length to suit individual users. To shorten cord 70, the user simply pulls on free end 79. To lengthen cord 70, the user first pulls on loop 74, then pulls on cord 70. To place the carry strap out of the way, the user simply folds the cord around handlebar 76.

SUMMARY, RAMIFICATIONS, AND SCOPE

Thus the reader will see that we have provided a holder and carrier which has many advantages over the prior-art canvas bag. It is balanced when loaded, it is comfortable and safe to carry, even on hilly terrain. It holds the required number of long or short laths and it is impossible for the laths to slide out, or to become mixed and require resorting. The laths can be inserted, one or two at a time, simply by inserting them into the passageway, or they can be loaded many at a time by first lifting the plunger. The laths can be removed by pulling the top lath out, or if the user prefers, the pressure exerted by the plunger can be relieved by manually lifting the plunger. It is made from material which is supportive of the material carried.

When using the carrier it is both easier and quicker to grasp its elevated handle. It is comfortable to carry, either by its handle alone, or together with a shoulder strap. When putting it down, its flat rigid bottom will support it in a standing position. The equipment is easy to see, remove, and when appropriate, replace.

The prism rod is in a handy position to remove and use, and replace, in either one of two positions. The carrier overcomes the problems associated with prior art bags, and reduces the time heretofore required to carry out a surveying job by at least 25 percent. It will not deteriorate or wear out as canvas bags do.

While the above description contains many specificities, the reader should not construe these as limitations on the scope of the inventions, but merely as exemplifications of preferred embodiments thereof. Those skilled in the art will envision that many other possible variations are within its scope. For example the carrier can be made with many other materials, such as plastic, or fiber impregnated plastic, carbon plastics, aluminium, or any other suitable material. The springs can be replaced with rubber or latex cords. The rubber pressure pads can be replaced with steel springs, or anchoring clips. The canvas pockets can be replaced with plastic pockets. The plunger can be an aluminium or even a plastic plunger, or it can be replaced with a simple weighted plunger, without the use of springs. The plunger can be made round, oval, or any other suitable shape. The passageway can be positioned horizontally, with the laths lying on their edges, as opposed to the passageway being vertical, and the laths stacked one above the other. The carrying strap can be replaced with any other form of shoulder strap.

Accordingly, the reader is requested to determine the scope of the invention by the appended claims and their legal equivalents, and not by the examples which have been given.

We claim:

1. A carrier for carrying surveyor's equipment, including laths having a predetermined width, comprising:

a base portion arranged such that said base portion will be generally horizontally oriented when said carrier is placed upon a horizontal surface, a pair of walls joined to said base portion so as to be upstanding from said base portion and generally vertically oriented when said carrier is placed upon said horizontal surface, said walls being generally parallel and having facing inner surfaces spaced apart by at least said predetermined width so as to provide a channel to hold said laths in a single-file stack, holding means having at least a part thereof within said channel for pressing said laths against said base to prevent said laths from falling out of said channel when said carrier is carried and when said laths are placed in said channel in a stack of from one to N laths, where N is a predetermined whole number, carrying means, including a handle, for enabling a person to lift and carry said carrier by grasping said handle with a single hand; and a carrying bin attached to an outer side of one side of one of said walls and extending up from said base portion such that said one wall forms one side of said bin.

2. The carrier of claim 1 wherein said holding means comprises a resilient member and a plunger attached to said resilient member, said resilient member being connected and arranged to urge said plunger downwardly, said plunger being positioned in said channel.

3. The carrier of claim 2 wherein said resilient member is elongated and has two opposite ends connected to said base portion at spaced locations, and an intermediate portion being connected to said plunger.

4. The carrier of claim 3 wherein said resilient member comprises a coil spring and said plunger comprises a block having a hole therethrough, said coil spring extending through said hole.

5. The carrier of claim 3, further including a pair of strips which form a triangle with said base, said resilient member extending within the confines of said strips.

6. The carrier of claim 5, further including means for holding said plunger at a location in said channel spaced above said strips.

7. The carrier of claim 2 wherein said resilient member is outside of said channel and adjacent to one of said walls, said resilient member being elongated and having two opposite ends connected to said base portion at spaced locations, and an intermediate portion being connected to said plunger.

8. The carrier of claim 7 wherein said resilient member comprises a coil spring and said plunger comprises a block having a hole therethrough, said coil spring extending through said hole, said one wall having a slot therethrough, said block extending through said slot.

9. The carrier of claim 7, further including a pair of strips outside of said channel, said strips forming a triangle with said base, said resilient member extending within the confines of said strips.

10. The carrier of claim 1, further including a second channel parallel and similar to said first-named channel and mounted generally parallel to said first-named channel and perpendicular to said base, and second holding means similar to said first-named holding means, said second holding means being associated with said second channel in a manner similar to the association of said first-named holding means with said first-named channel.

11. The carrier of claim 10 wherein said first-named and said second-named holding means are joined together.

12. A carrier for carrying surveyor's equipment, including laths having a predetermined width, comprising:

a base portion arranged such that said base portion will be generally horizontally oriented when said carrier is placed upon a horizontal surface, a pair of walls joined to said base portion so as to be upstanding from said base portion and generally vertically oriented when said carrier is placed upon said horizontal surface, said walls being generally parallel and having facing inner surfaces spaced apart by at least said predetermined width so as to provide a channel to hold said laths in a single-file stack, holding means having at least a part thereof within said channel for pressing said laths against said base to prevent said laths from falling out of said channel when said carrier is carried and when said laths are placed in said channel in a stack of from one to N laths, where N is a predetermined whole number, said holding means comprising a resilient member and a plunger attached to said resilient member, said resilient member being connected and arranged to urge said plunger downwardly, said plunger being positioned in said channel, and carrying means, including a handle, for enabling a person to lift and carry said carrier by grasping said handle with a single hand.

13. The carrier of claim 12 wherein said resilient member is elongated and has two opposite ends connected to said base portion at spaced locations, and an intermediate portion being connected to said plunger.

14. The carrier of claim 13 wherein said resilient member comprises a coil spring and said plunger comprises a block having a hole therethrough, said coil spring extending through said hole.

15. The carrier of claim 14 wherein said plunger comprises a block having a hole therethrough, said coil spring extending through said hole, said one wall having a slot therethrough, said block extending through said slot.

16. The carrier of claim 12, further including a carrying bin attached to an outer side of one side of one of said walls and extending up from said base portion such that said one wall forms one side of said bin.

* * * * *